US008540504B2

(12) United States Patent
Shieh et al.

(10) Patent No.: US 8,540,504 B2
(45) Date of Patent: Sep. 24, 2013

(54) EQUIPMENT FOR ELECTROSPINNING

(75) Inventors: Kuen-Wey Shieh, Taipei (TW); Chien-Chung Chen, Taipei (TW); Yung-Sheng Lin, Taipei (TW)

(73) Assignees: National Applied Research Laboratories, Taipei (TW); Taipei Medical University, Taipei (TW)

( * ) Notice: Subject to any disclaimer, the term of this patent is extended or adjusted under 35 U.S.C. 154(b) by 644 days.

(21) Appl. No.: 12/723,945

(22) Filed: Mar. 15, 2010

(65) Prior Publication Data

US 2010/0173035 A1 Jul. 8, 2010

Related U.S. Application Data

(63) Continuation-in-part of application No. 11/877,123, filed on Oct. 23, 2007, now abandoned.

(30) Foreign Application Priority Data

Apr. 20, 2007 (TW) ..... 96114167 A

(51) Int. Cl.
*B29C 47/00* (2006.01)

(52) U.S. Cl.
USPC ..... 425/174.8 E; 425/376.1; 425/DIG. 243; 264/465

(58) Field of Classification Search
None
See application file for complete search history.

(56) References Cited

U.S. PATENT DOCUMENTS 7,143,963 B2 * 12/2006 Tani et al. ..... 239/456

OTHER PUBLICATIONS

C.S. Kong, T.H. Lee, S.H. Lee, H.S. Kim, Nano-web formation by the electrospinning at various electric fields, Jun. 12, 2007, Journal of Material Science, vol. 42, p. 8106-8112.*

S.B. Mitchell, J.E. Sanders, A unique device for ontrolled electrospinning, Apr. 7, 2006, Journal of Biomedical Materials Research Part A, vol. 78A, p. 110-120.*

Fennessey et al., Fabrication of aligned and molecularly oriented electrospun polyacrylonitrile nanofibers and the mechanical behavior of their twisted yarns, Polymer 45 (2004) 4217-4225, Apr. 1, 2004.*

* cited by examiner

*Primary Examiner* — Benjamin Schiffman
(74) *Attorney, Agent, or Firm* — Volpe and Koenig, P.C.

(57) ABSTRACT

An electrospinning equipment is provided. The electrospinning equipment includes a power supply, a collector and a material supply electrically connected to the power supply facing the collector and having a spinneret and a guide unit coupled to the spinneret and bent toward the collector, and the spinneret is configured at a central portion of the guide unit.

6 Claims, 10 Drawing Sheets

EQUIPMENT FOR ELECTROSPINNING

CROSS-REFERENCE TO RELATED APPLICATIONS

This application is a Continuation-In-Part of co-pending application Ser. No. 11/877,123 filed on Oct. 23, 2007, and for which priority is claimed under 35 U.S.C. §120; and this application claims priority of Application No. 096114167 filed in Taiwan on Apr. 20, 2007 under 35 U.S.C. §119; the entire contents of all are hereby incorporated by reference.

FIELD OF THE INVENTION

The present invention relates to an electrospinning technique, and more particularly to an electrospinning equipment and an electrode structure thereof.

BACKGROUND OF THE INVENTION

The principle of the electrospinning technique is to provide a high-voltage electric field in an area which threads pass through after jetted from a spinning device, and when jetted from a spinneret of the spinning device, the threads are electrically charged by the spinning process; therefore, because of the electric property of the threads, the effect of the electric field on the threads results in finer threads. For the present techniques, the diameter of the threads can be as small as one hundred nanometers.

Please refer to FIG. 1, which shows a schematic diagram of an electrospinning equipment in the prior art. An electrospinning equipment 1 includes a collector 14 and a power supply PS electrically connected to a material supply 10, wherein the material supply 10 faces the collector 14; namely the normal to the plane of the collector 14 is parallel to the direction in which the material supply 10 supplies a material, and a diffusion electric field ef1 is generated therebetween. Besides, the material supply 10 usually is a capillary and has a spinneret 12 which a polymer solution FS is jetted from to form a thread F1. Ideally the thread F1 extends straightly toward the collector 14, but actually the thread F1 fluctuates transversely resulting from the electric charge repulsion inside the thread F1, and hence the thread F1 is usually deposited on the collector 14 disorderly. Therefore, the electrospinning technique is mostly applied to nonwoven manufacturing for its disordered arranging feature. On the contrary, it is difficult to roll the thread F1 on a roller used in other techniques, and rearranging the thread F1 and rolling it on the roller is unrealistic since it is time-consuming.

Please refer to FIG. 2, which shows a schematic diagram of another electrospinning equipment in the prior art. The electrospinning equipment comprises a first power supply PS1 electrically connected to a material supply 10 usually being a capillary and having a spinneret 12, a second power supply PS2 electrically connected to a circle 2, and a third power supply PS3 electrically connected to a collector 14. Compared with the electrospinning equipment 1 shown in FIG. 1, the one shown in FIG. 2 is to configure the circle 2 between the spinneret 12 and the collector 14 for forming stable threads without transverse fluctuation by providing an electric potential for the circle 2 through the second power supply PS2, wherein the electric potential of the circle 2 is higher than that of the collector 14 but lower than that of the material supply 10. Therefore, an upper electric field ef2*a* is generated between the circle 2 and the spinneret 12, and a lower electric field ef2*b* is generated between the circle 2 and the collector 14. A former thread F2*a* jetted from the spinneret 12 and passing through the upper electric field ef2*a* is in a straight state without transverse fluctuation. However, after passing through the circle 2 and reaching the area between the circle 2 and the collector 14, the former thread F2*a* becomes a latter thread F2*b*, and a diffusion is formed again. Nevertheless, the range of the transverse fluctuation of the latter thread F2*b* is smaller than that of the thread F1 shown in FIG. 1. Nevertheless, the range is not small enough to rearrange the thread F2*a* as a long straight state in a simple way.

Accordingly, in the field of electrospinning technique, a new structure is necessary for the thread to be deposited on the collector stably without transverse fluctuation.

SUMMARY OF THE INVENTION

In accordance with one aspect of the present invention, an electrospinning equipment including a power supply, a collector and a material supply is provided, wherein the material supply facing the collector is electrically connected to the power supply and has a spinneret and a guide unit coupled to the spinneret and bent toward the collector, and the spinneret is configured at a central portion of the guide unit.

Preferably, the power supply further includes a first electrode and a second electrode, wherein the first electrode is electrically connected to the guide unit, and the second electrode is mounted under the collector.

Preferably, the second electrode is configured in a distance away from the collector.

Preferably, the guide unit further includes an inner surface, and distances between each spot on the inner surface and the second electrode are equal.

Preferably, the guide unit is formed by extending outward from the spinneret toward the collector.

Preferably, the guide unit further includes an indentation surface facing the collector, and the indentation surface has an opening at a most distant location thereof from the collector, and the spinneret is located at the opening.

In accordance with another aspect of the present invention, an extension structure for an electrospinning equipment is provided. The extension structure includes an opening portion, a spinneret receiving portion and a body, wherein a width of the opening portion is larger than that of the spinneret receiving portion.

Preferably, the body is in a shape of a body portion of one selected from a group consisting of a bowl, a disc and a dome.

Preferably, the opening portion is in a shape of a fringe of the one selected from a group consisting of the bowl, the disc and the dome.

Preferably, the spinneret receiving portion is a center of the one selected from a group consisting of the bowl, the disc and the dome.

Preferably, the extension structure further includes an inner surface and an outer surface, wherein the inner surface borders the outer surface on the opening portion, and the spinneret receiving portion of the extension structure is positioned at a location most distant from the opening portion.

Preferably, the extension structure is a tube, wherein the opening portion and the spinneret receiving portion are openings of the tube, and the tube is diverged from one of the openings to the other one.

In accordance with a further aspect of the present invention, an electrospinning method is provided. The electrospinning method includes steps of (1) providing a material supply, (2) providing a collector under the material supply, and (3) generating an electric field between the material supply and the collector, wherein a pattern of the electric field is convergent from the material supply to the collector.

Preferably, the electric field is generated by providing an extension structure extending outward from the material supply toward the collector.

Preferably, the extension structure has a body, and the body is in a shape of a body portion of one selected from a group consisting of a bowl, a disc and a dome.

Preferably, the electric field is generated by a power supply having a first electrode coupled to the material supply and a second electrode, where the collector is located between the second electrode and the material supply.

Preferably, the electrospinning method further includes a step of (4) moving the collector to make a thread deposited at different locations of the collector.

Additional objects and advantages of the invention will be set forth in the following descriptions with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
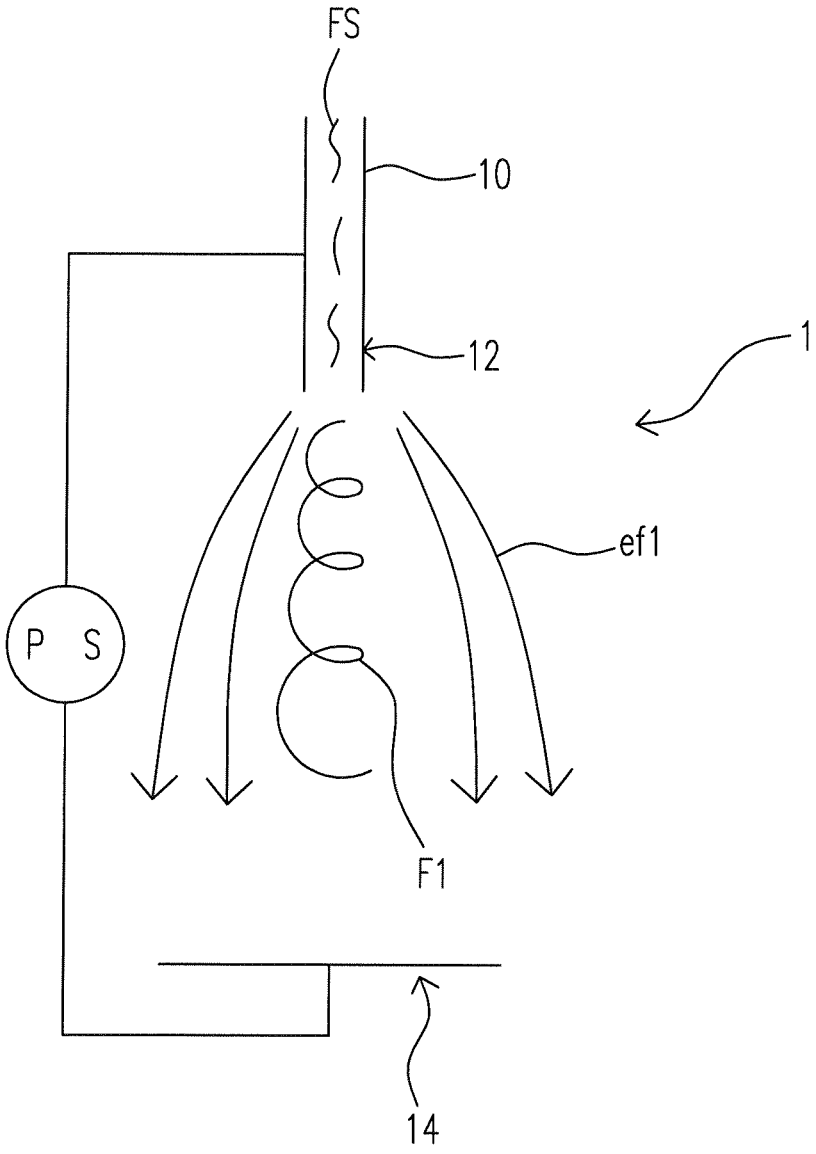
Fig. 1 (PRIOR ART)
FIG. 1 is a schematic diagram showing an electrospinning equipment in the prior art.
Figure 2:
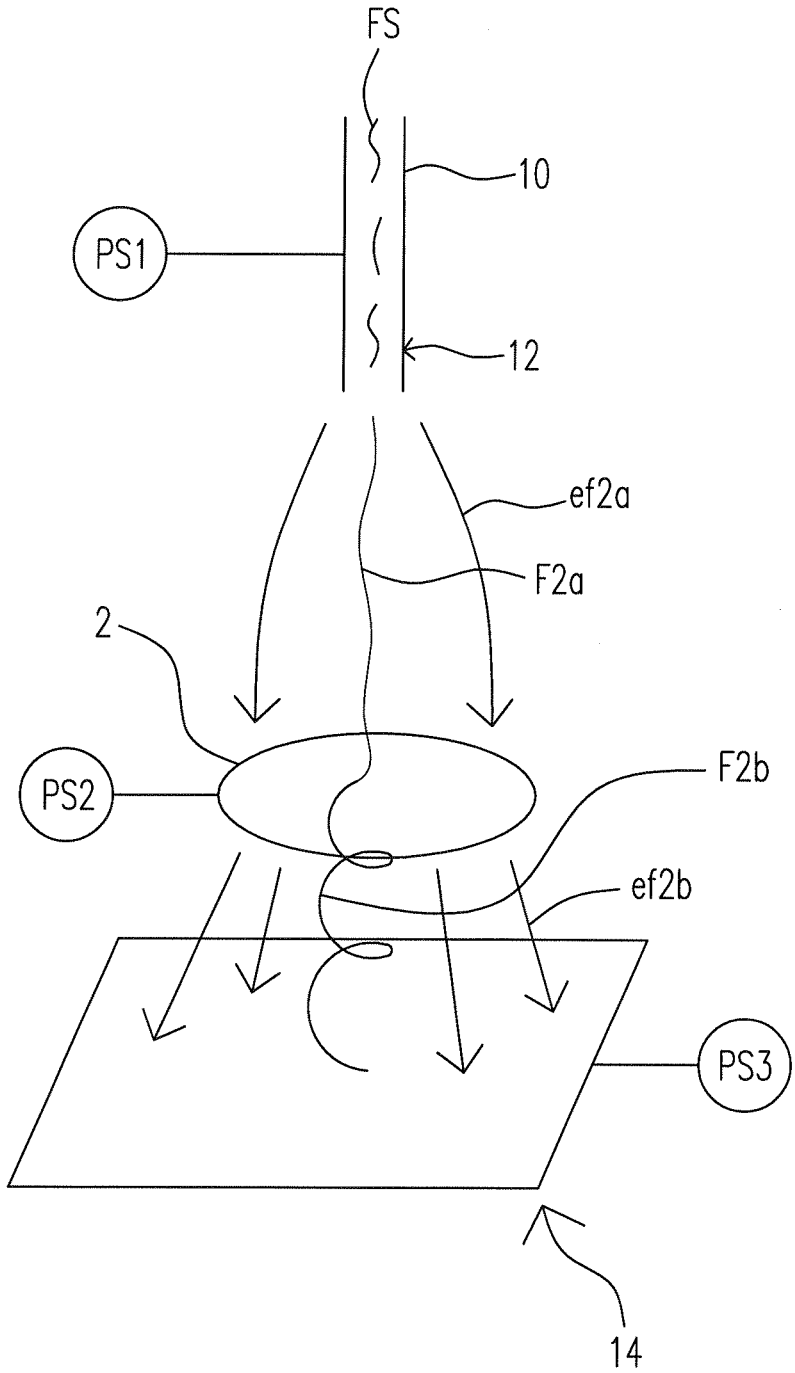
Fig. 2(PRIOR ART)
FIG. 2 is a schematic diagram showing another electrospinning equipment in the prior art.
Figure 3:
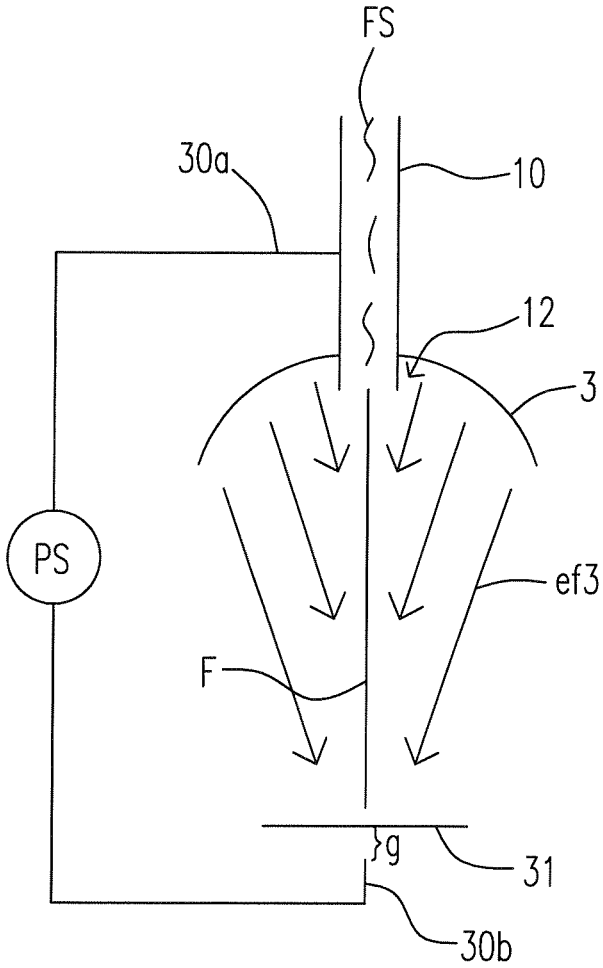
FIG. 3 shows the electrospinning equipment according to a preferred embodiment of the present invention.

Please refer to FIG. 3, which shows a schematic diagram of the electrospinning equipment according to a preferred embodiment of the present invention. The electrospinning equipment includes a material supply 10 facing a collector 31, wherein the material supply 10 is usually made as a capillary and has a spinneret 12, and the collector 31 is used for collecting a thread F formed by a polymer solution FS jetted from the spinneret 12. Additionally, the material supply 10 is connected to a power supply PS; usually a first electrode 30*a* is connected to the material supply 10, and a second electrode 30*b* is mounted under the collector 31. While one of the first electrode 30*a* and the second electrode 30*b* is the anode, the other one is the cathode.

Moreover, in order to overcome the drawback of the unstable electric field in the prior art, a guide unit 3, which is a 3D sheet-form structure, is coupled to the material supply 10 in the present invention. Please refer to FIG. 3 which shows a cross-sectional view of the guide unit 3, wherein the guide unit 3 is formed by extending outward from the material supply 10 and bending toward the collector 31. As a result, the guide unit 3 is a downcast curve as shown in FIG. 3 and is an extension structure having an indentation surface facing the collector 31. In addition, the indentation surface has an opening at a most distant location of the guide unit 3 from the collector, and the spinneret 12 is located at the opening. The second electrode 30*b* is a point-like electrode, and an electric field ef3 is generated and a pattern of the electric field ef3 converges from the indentation surface of the guide unit 3 to the second electrode 30*b*, so that the electric field ef3 is controlled in quite a stable state. Thus, when the polymer solution FS in the material supply 10 is jetted from the spinneret 12 and affected by the downward convergent electric field ef3 pattern, the lower the higher-density the electric field ef3 becomes, and hence the thread F does not fluctuate transversely. Therefore, the thread F reaches the collector 31 almost in a straight state, and it is much easier to arrange the thread F deposited on the collector 31. Although the transverse fluctuation of the thread F still occurs slightly, it can be controlled in a range by using the guide unit 3 of the present invention and is unlike the thread that is irregular and substantial swinging in the prior art.

Furthermore, unlike the second electrode connected to the collector directly in the prior art, the second electrode 30*b* is configured in a distance g nearby but away from the collector 31. Thus, the collector 31 can shift above the second electrode 30*b*, and the thread F can be deposited on the collector 31 in different layouts through the arrangement of the shifting direction thereof.

In addition, the shape of the guide unit 3 can be defined as a partial surface of a sphere, wherein the second electrode 30*b* is the center of the sphere, and the distance between the second electrode 30*b* and the spinneret 12 is the radius of the sphere. That is to say, distances between each spot on the inner surface of the guide unit 3 and the second electrode 30*b* are equal, which achieves a more stable electric field.

Figure 4:
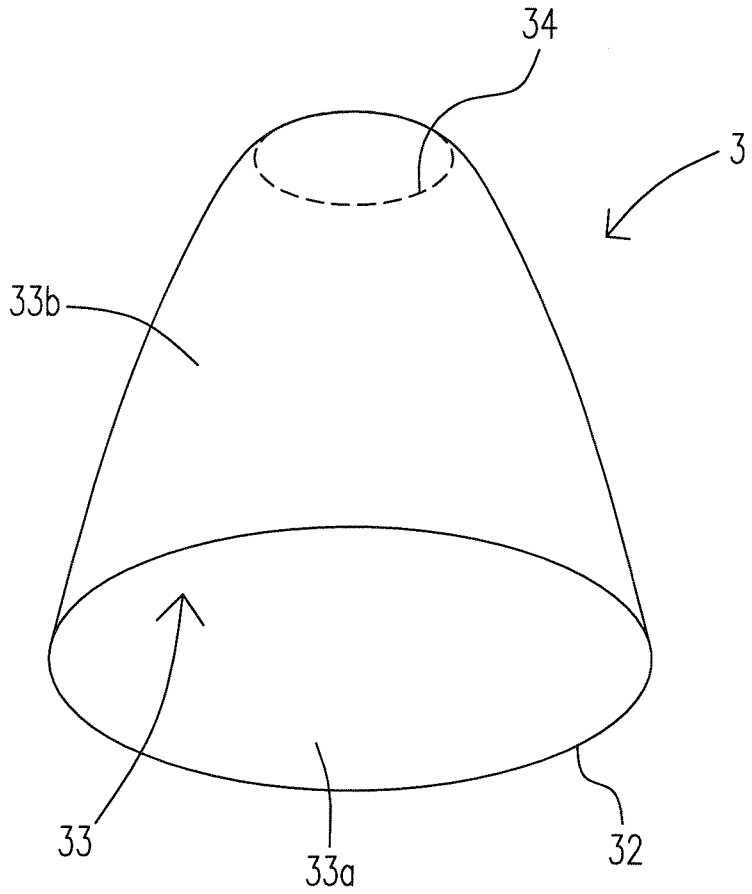
FIG. 4 is a 3D schematic view of the extension structure of the electrospinning equipment according to a preferred embodiment of the present invention.

Please refer to FIG. 4, which is a 3D schematic view of the extension structure of the electrospinning equipment according to a preferred embodiment of the present invention, which is also a new invention of an electrode structure of the electrospinning equipment. As shown in FIG. 4, the guide unit 3 includes an opening portion 32, a spinneret receiving portion 34 and a body, wherein the body of the guide unit 3 is in a shape of a body portion of one selected from a group consisting of a bowl, a disc and a dome. If the distance between the opening portion 32 and the spinneret receiving portion 34 is shorter, such as a distance shorter than the radius of the opening portion 32, the guide unit is like a disc. If the distance therebetween is about equal to the radius of the opening portion 32, the guide unit is like a bowl. If the distance therebetween is longer than the radius of the opening portion 32 a certain extent, the guide unit is like a cup. The radius of the opening portion 32 is longer than that of the spinneret receiving portion 34, and the spinneret 12 is configured at the spinneret receiving portion 34 as shown in FIG. 3. Besides, the body of the guide unit 3 between the spinneret receiving portion 34 and the opening portion 32 is in a shape of a curve surface and is extending outward.

Please refer to FIG. 4 again, which shows the guide unit 3 of the present invention in another aspect. The guide unit 3 includes an inner surface 33*a* and an outer surface 33*b*, wherein the inner surface 33*a* borders the outer surface 33*b* on the opening portion 32, and the spinneret receiving portion 34 is positioned at a location most distant from the opening portion 32. Moreover, a space surrounded by the inner surface 33*a* is an electric field space 33. In a further aspect of the guide unit 3 of the present invention, the guide unit 3 is a tube, wherein the opening portion 32 and the spinneret receiving portion 34 are openings of the tube, and the tube is diverged from the spinneret receiving portion 34 to the opening portion 32.

Figure 5:
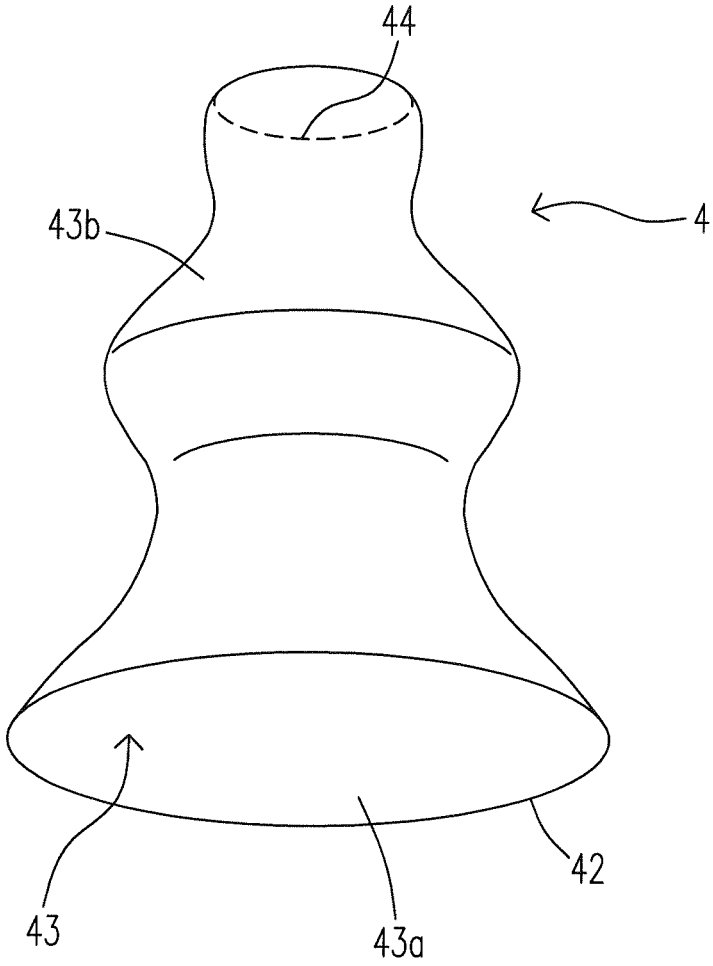
FIG. 5 is a 3D schematic view of the extension structure of the electrospinning equipment according to another preferred embodiment of the present invention.

Please refer to FIG. 5, which shows a 3D schematic view of the extension structure of the electrospinning equipment according to another preferred embodiment of the present invention. The extension structure 4 includes an opening portion 42, a spinneret receiving portion 44 and a body, wherein the opening portion 42 and the spinneret receiving portion 44 are respectively located at the two ends of the extension structure 4, and the body therebetween is a wave-shape structure which increases the strength of the extension structure 4 and keeps it away from deformed easily due to crashes and squeezes. The same with the guide unit 3 shown in FIG. 4, the extension structure 4 includes an inner surface 43*a* and an outer surface 43*b*, wherein the inner surface 43*a* borders the outer surface 43*b* on the opening portion 42, and a width of the opening portion 42 is larger than that of the spinneret receiving portion 44. In addition, a space surrounded by the inner surface 43*a* is an electric field space 43.

Figure 6:
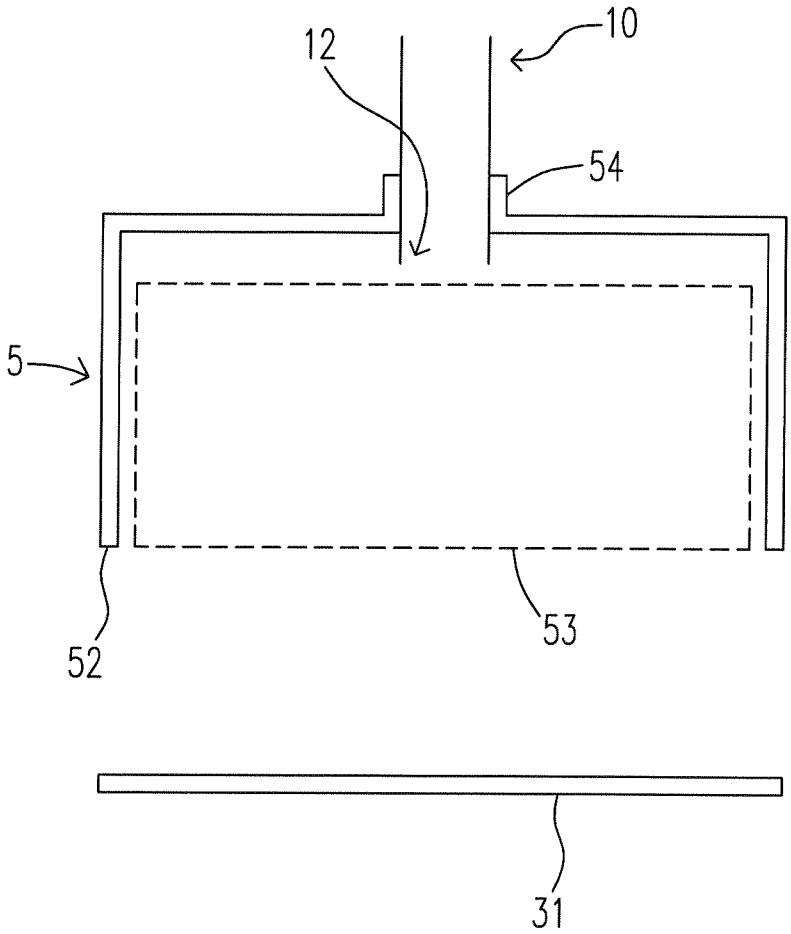
FIG. 6 is a cross-sectional view of the extension structure of the electrospinning equipment according to a further preferred embodiment of the present invention.

Please refer to FIG. 6, which is a cross-sectional view of the extension structure of the electrospinning equipment according to a further preferred embodiment of the present invention. The cross-sectional view of the extension structure 5 is a square appearance, and the shape of the body thereof is a cylinder or a box. The extension structure 5 also includes an opening portion 52, a spinneret receiving portion 54 and a body, wherein a width of the opening portion 52 is obviously larger than that of the spinneret receiving portion 54, and an electric field space 53 is formed inside the extension structure 5. The extension structure 5 is coupled to the material supply 10, and the spinneret 12 is configured in the extension structure 5; the electric field space 53 is formed between the spinneret 12 and the collector 31.

Figure 7:
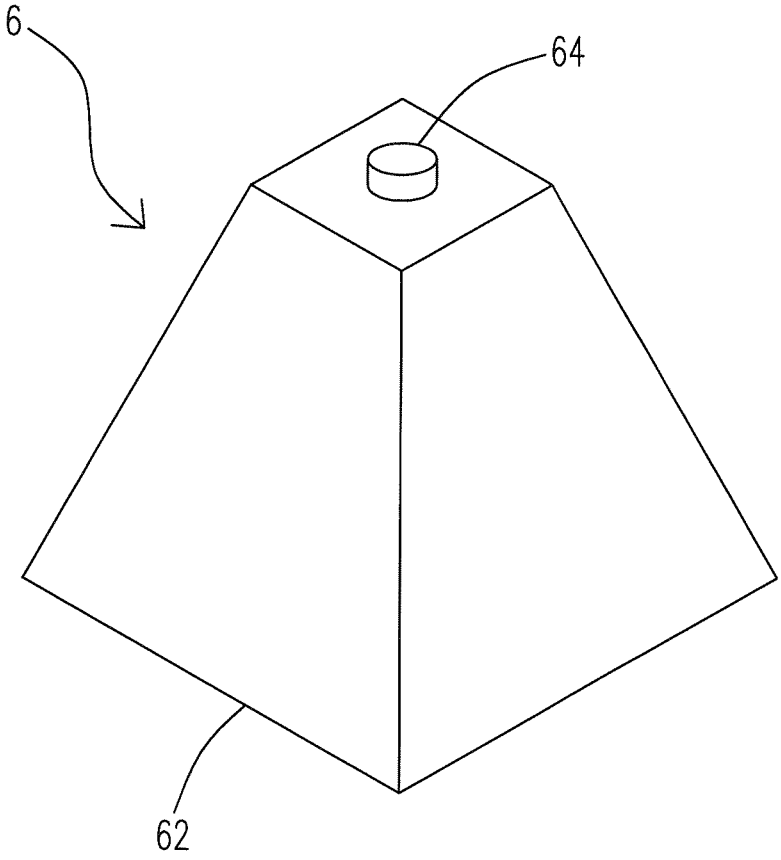
FIG. 7 is a 3D schematic view of the extension structure of the electrospinning equipment according to further another preferred embodiment of the present invention.

Please refer to FIG. 7, which is a 3D schematic view of the extension structure of the electrospinning equipment according to further another preferred embodiment of the present invention, wherein the extension structure 6 is in a shape of a multilateral pyramid. In this preferred embodiment, the extension structure 6 is in a shape of a quadrilateral pyramid, wherein a spinneret receiving portion 64 is configured on the top of the pyramid, and an opening portion 62 also having a width larger than that of the spinneret receiving portion 64 is located at the base of the pyramid.

Therefore, the extension structure of the present invention is generally a structure coupled to the material supply 10, and is formed by extending outward from the spinneret 12 toward the collector 31. That is to say, no matter what shape the extension structure is, such as the various ones disclosed in FIGS. 3-7, the basic shape of the extension structure is that the width of the end connected to the material supply (which is the spinneret receiving portion) is smaller than that of the end away from the material supply (which is the opening portion), which means the circumference, the diameter, the edge length or the cross-section area measure of the opening portion is larger than that of the spinneret receiving portion. In other words, in the present invention, the spinneret receiving portion is connected to the opening portion by a body structure, and the body structure can be made by shell manufacturing for the convenience of the manufacturing process or for the necessity of light-weight.

The aim of the present invention is to let the thread reach the collector stably without transverse fluctuation. The method to achieve the aim is to stabilize the electric field between the material supply and the collector, and further to restrict the thread jetted from the material supply, so that the thread can reach the collector nearly without transverse fluctuation. In accordance with a further aspect of the present invention, an electrospinning method is provided. Referring to FIG. 3, the electrospinning method includes steps of (1) providing a material supply 10, (2) providing a collector 31 under the material supply 10, and (3) generating an electric field ef3 between the material supply 10 and the collector 31, wherein a pattern of the electric field ef3 is convergent from the material supply 10 to the collector 31.

More briefly, the method of the present invention is to generate an electric field between the material supply and the collector, and the electric field pattern is convergent from the material supply to the collector. As shown in FIG. 3, the material supply 10 is located above the collector 31, wherein the pattern of the electric field ef3 is like a shape of an inverted cone.

As to the method to generate the electric field ef3, it is achieved by forming an extension structure 3 by extending outward from the material supply 10 toward the collector 31. The body of the extension structure 3 is in a shape of a body portion of one selected from a group consisting of a bowl, a disc and a dome.

Please refer to FIG. 3 again. The electric field ef3 is generated by a power supply PS having a first electrode 30*a* coupled to the material supply 10 and a second electrode 30*b*, where the collector 31 is located between the second electrode 30*b* and the material supply 10. In other words, as shown in FIG. 3, the second electrode 30*b* is mounted under the collector 31. In addition, the second electrode 30*b* is configured in a distance g away from the collector 31, so that the collector 31 is movable for changing the location which the thread F is deposited at after jetted from the material supply 10.

Figure 8:
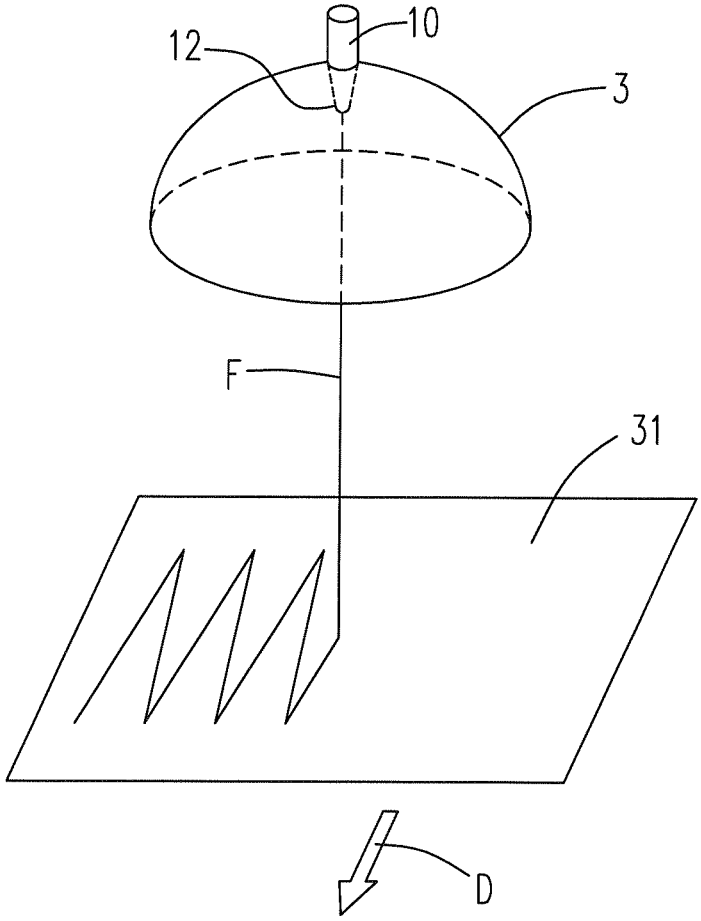
FIG. 8 shows the application of the electrospinning equipment in the present invention.

Please refer to FIG. 8, which shows the application of the electrospinning equipment in the present invention. The material supply 10 is located above the collector 31, and the thread F is jetted from the spinneret 12 toward the collector 31 and deposited on the collector 31 through a stable and straight route using the extension structure 3 of the present invention. As shown in FIG. 8, due to the movable collector 31, a flex diagram of the thread F can be weaved thereon. At the moment shown in FIG. 8, the collector 31 is moving toward a direction D to deposit the thread F toward the opposite direction of the direction D.

Figure 9:
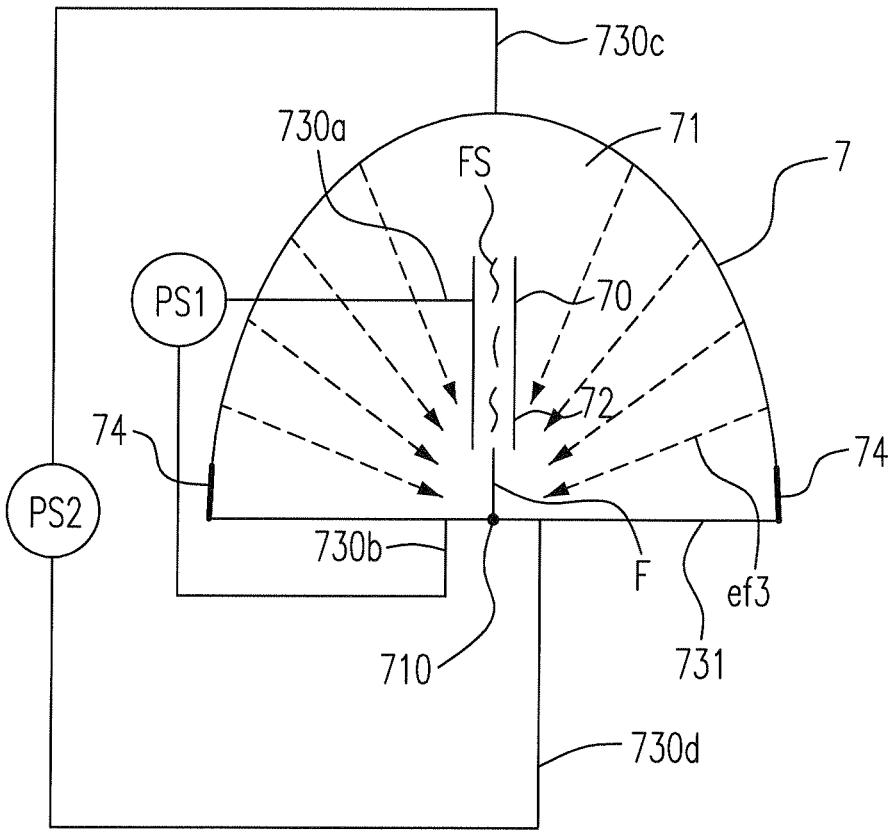
FIG. 9 shows the electrospinning equipment according to another preferred embodiment of the present invention.
Figure 10:
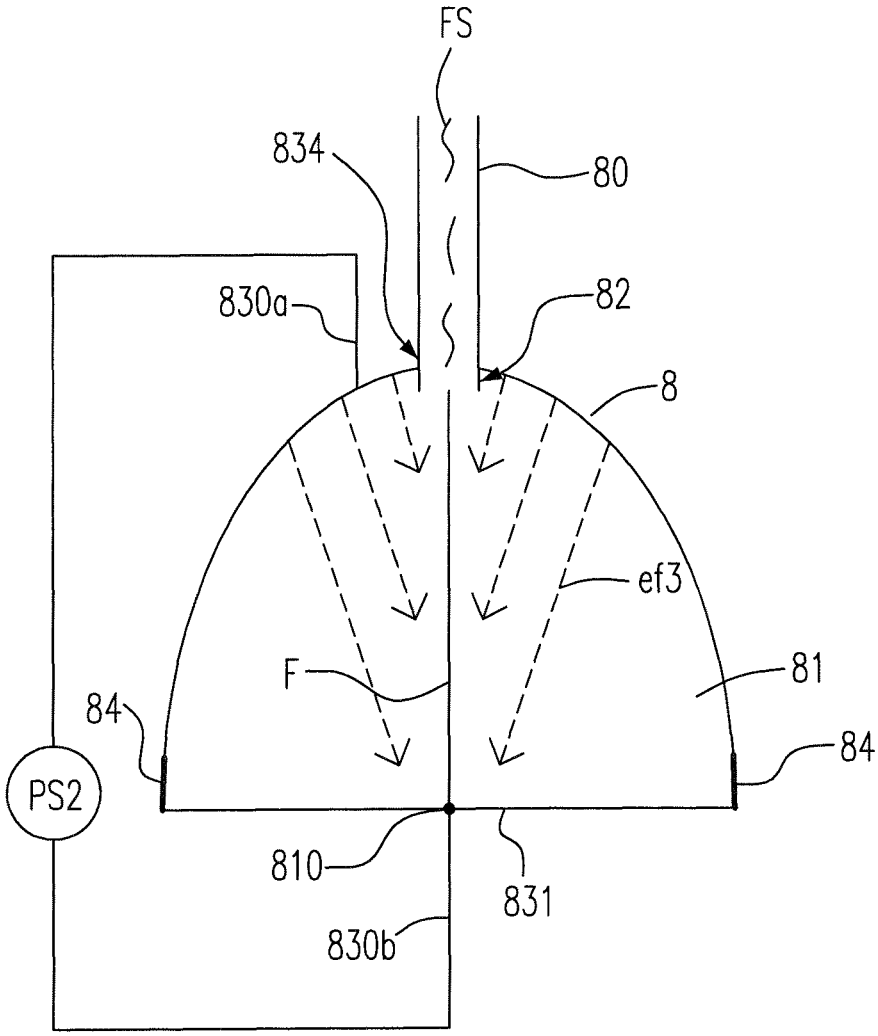
FIG. 10 shows the electrospinning equipment according to the other preferred embodiment of the present invention.

Alternatively, the present invention could be demonstrated in other embodiments as illustrated in FIGS. 9 and 10. Please refer to FIG. 9. Firstly, the extension structure 7 (or the guide unit 7) forms a spherical or oval enclosed structure 7 covering the material supply 70, the spinneret 72 and the collector 731, so as to form an enclosed space 71 between the enclosed structure 7 and the collector 731. The material supply 70 is connected with a first power supply PS1, wherein the first electrode 730*a* and the second electrode 730*b* are connected with the material supply 70 and the collector 731, respectively. The enclosed structure 7 is connected with a second power supply PS2, wherein the third electrode 730*c* and the fourth electrode 730*d* are connected with the upper section of the enclosed structure 7 and the collector 731, respectively. The enclosed structure 7 further comprises an insulating structure 74, which is located on both end of the enclosed structure 7 and is connected to the collector 731. As a result, the inner space of the enclosed structure 7, or the enclosed space 71, can generate an electric field ef3. It is to be noticed that the center 710 of the spherical enclosed structure 7 or the focal point 710 of the oval enclosed structure 7 needs to be located on the collector 731 so that the electric field ef3 can converge toward the collector 731 to allow the thread F firmly spray thereon. Moreover, the power supplies PS1 and PS2 in this embodiment are not limited, they can be replaced with one power supply connected to the enclosed structure 7, the material supply 70 and the collector 731 at the same time.

In FIG. 9, the material supply 70 is coupled but separated from the enclosed structure 7; while it is also possible to allow them to be connected with each other as shown in FIG. 10, which demonstrates that the enclosed structure 8 covering the spinneret 82 and the collector 831 so as to form an enclosed space 81 between the enclosed structure 8 and the collector 831, wherein the material supply 80 is partially enclosed by the enclosed structure 8, and the enclosed structure 8 further includes a spinneret receiving portion 834 for connecting with the spinneret 82, and an insulating structure 84 located on both end of the enclosed structure 8 and is connected to the collector 831. Still, the center 810 of the spherical enclosed structure 8 or the focal point 810 of the oval enclosed structure 8 needs to be located on the collector 831, to make the electric field ef3 converge toward the collector 831 therefore. Basically, the enclosed structure 7, 8 as demonstrated in FIGS. 9-10 would make the thread collection become much more firm and stable than the traditional structure, since the thread F in the enclosed space 71, 81 will not be affected by the factors or interferences outside of the enclosed structure 7, 8, and therefore exclude all the negative effect, so that the objective of the present invention can be well and efficiently achieved.

In conclusion, in order to prevent the fluctuation of the thread during the electrospinning process, the present invention provides a special electric field between the material supply and the collector, wherein the electric field pattern is convergent from the material supply to the collector, so that the thread reaches the collector stably without fluctuation after jetted from the material supply. The convergent electric field pattern is generated by providing the extension structure of the present invention extending outward from the material supply toward the collector, wherein one of the extension structure is like an inverted bowl. Therefore, the equipment and method disclosed herein provide more possibility for electrospinning technique.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An electrospinning equipment, comprising:

a power supply;

a collector;

a material supply electrically connected to the power supply, facing the collector and having a spinneret; and a guide unit electrically connected to the power supply and covering the spinneret and the collector to form an enclosed space between the guide unit and the collector, wherein the guide unit comprises an insulating structure located on both ends of the enclosed space and is connected to the collector, so that the electrospinning equipment has an electric field formed inside the enclosed space and converging toward the collector.

2. An electrospinning equipment according to claim 1, wherein the power supply further comprises a first power supply and a second power supply, the first power supply is electrically connected to the material supply, and the second power supply is electrically connected to the guide unit.

3. An electrospinning equipment according to claim 1, wherein the guide unit further has a center or a focal point located on the collector.

4. An electrospinning equipment according to claim 3, wherein the guide unit further has an inner surface and distances, which between everywhere on the inner surface and the center are equal.

5. An electrospinning equipment according to claim 1, wherein the guide unit is formed by extending outward from the spinneret toward the collector.

6. An electrospinning equipment according to claim 1, wherein the guide unit further has an indentation surface facing the collector, the indentation surface has an opening being farthest away from the collector, and the spinneret is located at the opening.

* * * * *